US006497166B1

(12) United States Patent
Fleckenstein

(10) Patent No.: US 6,497,166 B1
(45) Date of Patent: Dec. 24, 2002

(54) SCREW SETTER TOOL

(76) Inventor: Mark Fleckenstein, 6769 N. FM 51, Decatur, TX (US) 76234

( * ) Notice: Subject to any disclaimer, the term of this patent is extended or adjusted under 35 U.S.C. 154(b) by 0 days.

(21) Appl. No.: 09/795,711

(22) Filed: Feb. 28, 2001

Related U.S. Application Data

(60) Provisional application No. 60/246,442, filed on Nov. 7, 2000.

(51) Int. Cl.[7] ..... B25B 23/10
(52) U.S. Cl. ..... 81/451; 87/453
(58) Field of Search ..... 81/451–458, 429

(56) References Cited

U.S. PATENT DOCUMENTS

| | | | | | |
|---|---|---|---|---|---|
| 96,263 | A | * | 10/1869 | Pinner | 81/453 |
| 1,412,550 | A | * | 4/1922 | Bentley | 81/453 |
| 1,712,196 | A | | 5/1929 | Burger et al. | |
| 1,754,739 | A | * | 4/1930 | Calvert | 81/455 |
| 1,755,588 | A | * | 4/1930 | Bronk | 81/455 |
| 3,288,184 | A | | 11/1966 | Kyser | |
| 3,901,298 | A | * | 8/1975 | Eby | 81/455 |
| 4,140,161 | A | | 2/1979 | Russo et al. | |
| 4,190,091 | A | * | 2/1980 | Colognori | 81/453 |
| 5,207,127 | A | | 5/1993 | Nick | |
| 5,667,516 | A | | 9/1997 | Torrie et al. | |
| 5,996,452 | A | | 12/1999 | Chiang | |
| 6,116,125 | A | | 9/2000 | McLeod | |
| 6,138,538 | A | | 10/2000 | Neijndorff | |
| 6,244,141 | B1 | * | 6/2001 | Han | 81/453 |

* cited by examiner

*Primary Examiner*—D. S. Meislin
(74) *Attorney, Agent, or Firm*—Lee, Mann, Smith, McWilliams, Sweeney and Ohlson

(57) ABSTRACT

This invention is directed to a screw setting device which is connected to an electric drill and is designed not to release from a screw head until a screw is completely installed. The screw setting device includes a shank, prongs, a collet a driving tip, a sleeve and a collar. The shank attaches to a chuck of the electric drill and is connected to the driving tip and the prongs. The driving tip and prongs are adapted to engage front, rear surfaces and a recess in the screw head. The screw head cannot be released from the driving tip and prongs when the sleeve is slid to the forward position. As the screw becomes completely installed, the sleeve slides rearward, releasing the screw setting device from the screw.

14 Claims, 3 Drawing Sheets

FIG. 1
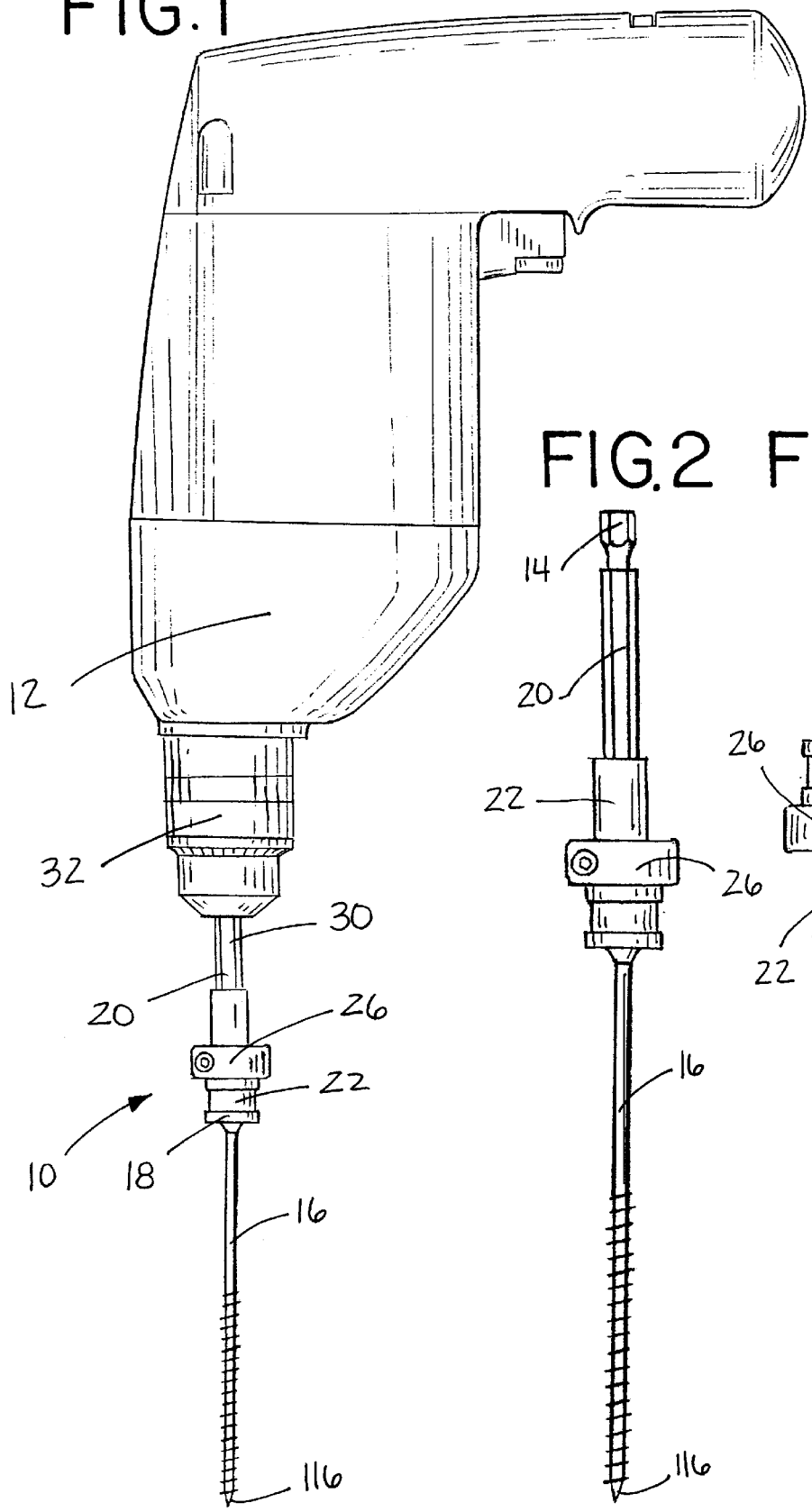
FIG. 2
FIG. 3
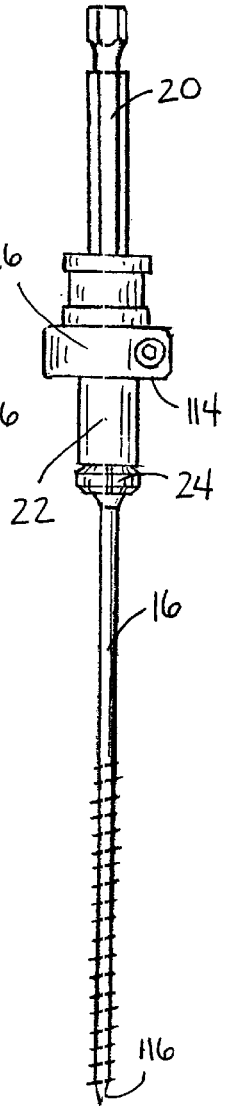

SCREW SETTER TOOL

SCREW SETTER TOOL

This application claims priority from Provisional Application No. 60/246,442 filed on Nov. 7, 2000.

BACKGROUND OF THE INVENTION

This invention may be described as a screw setter device, which can be connected to an electric drill or screwdriver at a first end and to a screw or other fastener at a second end to provide for a screw securing system that holds a screw in place during installation and does not release from the screw until completely installed.

DESCRIPTION OF RELATED ART

Devices used for the installation of screws into wood and other materials typically have a tip that is designed to engage the head of a screw and secure it to a screw driver or other driving tool to allow the screw to be rotated. These tips are of specific designs such as phillips, flat, torx, square and clutch and are sized to match the design of the screw head and can be found on screwdrivers and drill tips. Ordinarily when installing screws, a pilot hole needs to be drilled first before the screw is installed to facilitate easier installation of screws. Self-starting screws, such as deck screws, can be installed without drilling a pilot hole, but the friction created by the screw threads burrowing into the wood is so great that it is impossible to install the screws by hand and can be challenging when installed with an electric drill or screwdriver. Typically, the rotational force exerted by the drill is great enough to drive the screws into the wood material but the connection between the driving tip and the screw head is easily overcome by the torque of the drill and the resistence of the screw to turn, causing the driving tip to jump out of the screw head. This causes either the screw head or the driving tip to round out, destroying the engaging surfaces. The prior art devices do not provide for a screw setter tool that securely engages a screw head to allow for the installation of screws without pre-drilling a pilot hole.

SUMMARY OF THE INVENTION

This invention may be described as a screw setter device that is designed to engage the outer surface of the head of a screw to secure the driving tip in driving engagement with the screw and to thereby prevent the driving tip from jumping out of the screw slot during installation. The screw setter device includes a shank, a collet, prongs, a sleeve, an adjustable collar, and a driving tip. The shank is installed into an electric drill, screwdriver or ratchet and is connected to the driving tip and the prongs. The driving tip is connected to the shank and is oriented between the prongs. The driving tip can be of numerous shapes to fit the head of the screw including phillips, flat, square, torx and clutch. Other driving tips of varying styles and sizes can be used to adapt to the different screw heads. The prongs are part of the collet and surround the driving tip and are designed to engage the outer surface of the screw head to prevent disengagement. The sleeve is positioned around the shank and slidably engages the prongs to enclose them around the head of the screw. The sleeve is designed so that when the screw is completely installed, the contact of the sleeve with the surface into which the screw is installed causes the sleeve to slide rearward releasing the prongs from the screw head. The collar slides over the sleeve and is designed to allow for varying depth release of the screw from the surface of the wood. The screw setter tool allows a user to install screws into wood surfaces or any other surfaces without drilling a pilot hole or applying undue pressure to the back of the drill to maintain the driving tip to screw head engagement.

BRIEF DESCRIPTION OF THE DRAWINGS

FIG. 1 is a side view of the screw setter device of the present invention connected to an electric drill at a first end and to a screw at a second end.

FIG. 2 is a side view of the screw setter device of the present invention.

FIG. 3 is a side view of the screw setter device of the present invention with the sleeve reversed.

DETAILED DESCRIPTION OF THE INVENTION

Figure 4:
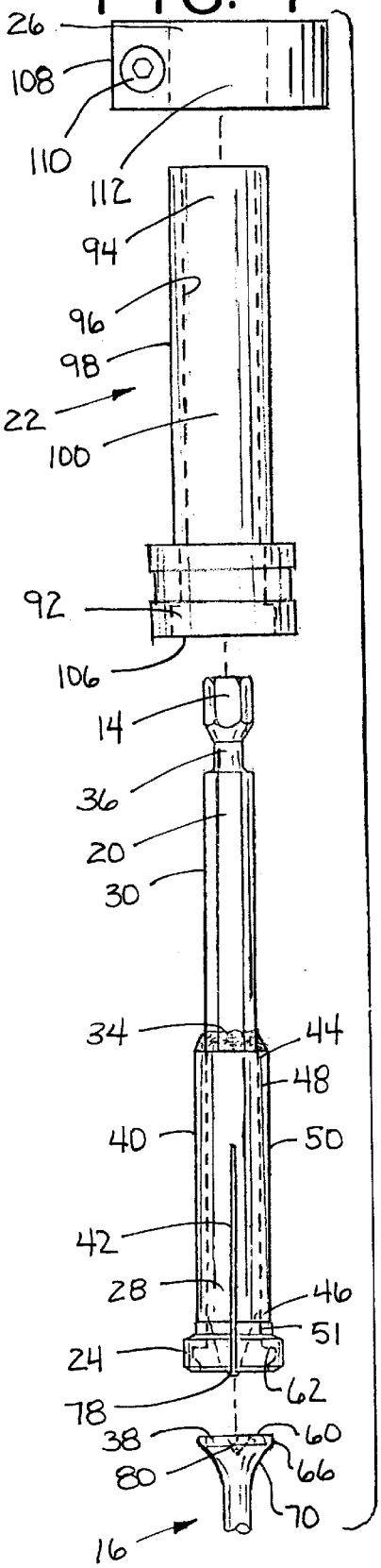
FIG. 4 is an exploded view of the screw setter device of the present invention.

For the purpose of promoting an understanding of the principles of the invention, references will be made to the embodiments illustrated in the drawings. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

A preferred embodiment of the screw setter device 10 of the present invention is shown in FIG. 1 attached to a drill 12 at a first end 14 and allows for the attachment of a screw 16 to a second end 18. The screw setter device 10 allows the user to install screws 16 without the need to drill a pilot hole or apply undue pressure to the back surface of the drill 12. The screw setter device 10 includes a shank 20, a sleeve 22, a collet 40, prongs 24 (shown in FIG. 4), an adjustable collar 26, and a driving tip 28, shown in FIG. 5. The shank 20 is adapted to extend longitudinally outward from the drill 12. The shank 20 has an outer surface 30 that can have a smooth shape or a hexagonal shape. The hexagonal shape is desirable because it allows the screw setting device 10 to be installed in drills 12 with a variable chuck 32 and also electric screwdrivers (not shown) with a hexagonal chuck (not shown). The shank 20, shown in FIGS. 1&4, is adapted to be attached to the drill 12 at the first end 14 and connected to the prongs 24 and driving tip 28 at a second end 34. The number of prongs may vary depending on the size of the device but generally three or four prongs are sufficient. The prongs surround the driving tip 28 which is connected to the shank 20. The shank 20 may also include an annular groove 36 near the first end 14 so the screw setter device 10 can be locked into a chuck 32 with a locking mechanism (not shown) if so equipped. It is also possible to form the driving tip 28 and the shank 20 out of a single piece of metal to increase strength.

The prongs 24, shown in FIG. 4, are designed to surround the head 38 of the screw 16 and are part of a metal collet 40.

Figure 9:
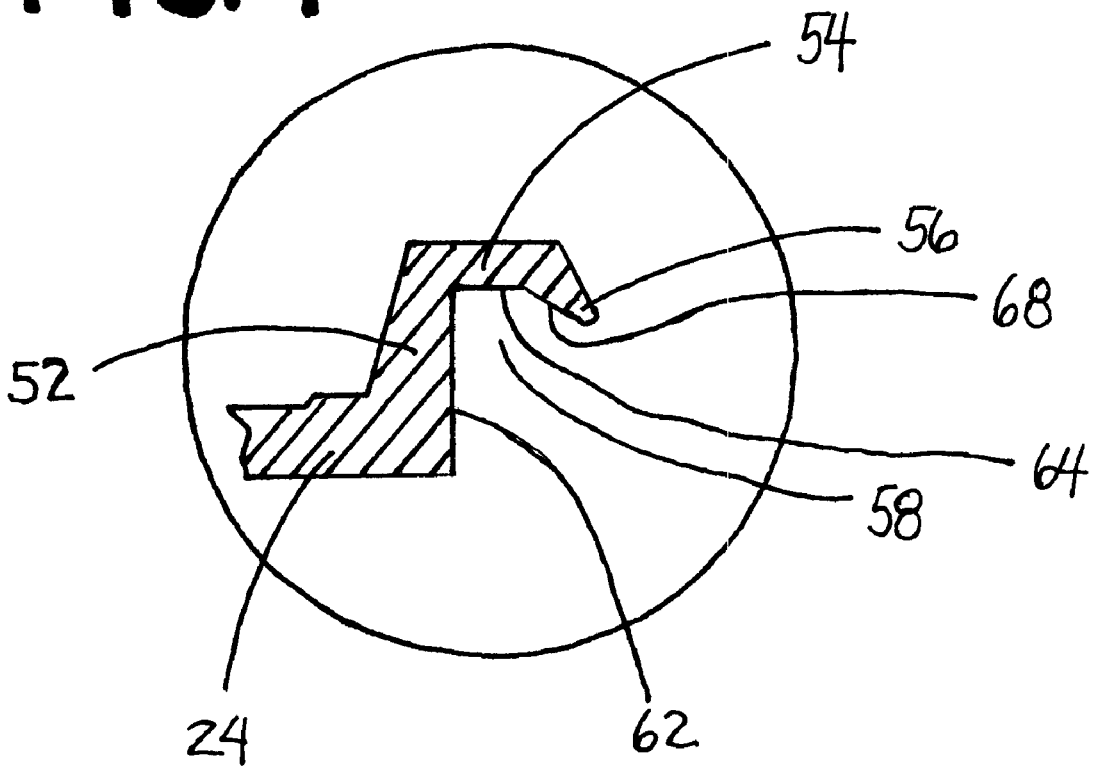
FIG. 9 is a cross-sectional view of the prong of the present invention.

The spacing of the prongs 24 is such that they will surround the screw head 38 without grippingly engaging it until biased inwardly. The collet 40 is cylindrical in shape and includes slots 42 to divide the collet into individual prongs 24 which are biased radially outwardly from the central axis. The collet 40 has a first end 44 and a spaced apart second end 46. The collet 40 also includes an inner surface 48 and an outer surface 50. The outer surface 50 includes a raised ring 51 to aid in closing the prongs 24. The inner surface 48 of the collet 40 is sized so that the collet 40 can be slid over the outer surface 30 of the shank 20. Once in position, the collet 40 is fastened to the shank 20 by welding, epoxy, rivets, bolts or other fastener means know to those skilled in the art. The inner surface 48 of the collet 40 may be hexagonal in shape to allow for the driving tips 28 to be interchanged when worn or when a different style tip is needed. The slots 42 are cut laterally into the collet 40 and allow for the prongs 24 to be opened or closed around the head 38 of the screw 16. The prongs 24, shown in FIG. 9, which are located at the second end 46 of the collet 40 include an outwardly extending member 52, a crown 54 and a retaining clip 56 to create an annular recess 58 that is adapted to engage and secure the head 38 of the screw 16 when the prongs 24 are biased to the closed position. When the screw head 38 is inserted between the prongs 24 in the open position, the front face 60 of the screw head 38 is in contact with the rear surface 62 of the annular recess 58. When the prongs 24 are biased to the closed position, the inside surface 64 of the crown 54 is in contact with the edge 66 of the screw head 38 and the inside surface 68 of the retaining clip 56 is in contact with the rear face 70 of the screw head 38, which prevents the screw 16 from being released by the prongs 24. When the prongs 24 are in the open position, the screw head 38 is no longer retained by the retaining clips 56 and can be removed from the screw setter device 10.

Figure 5:
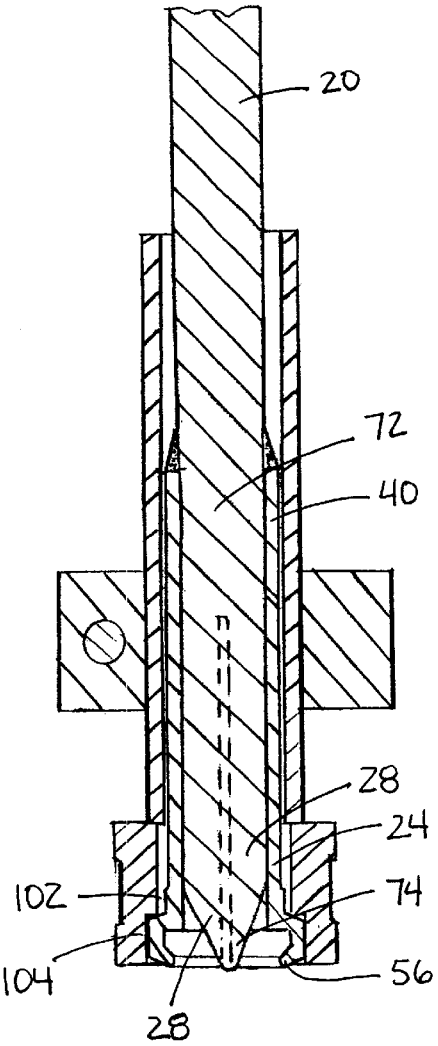
FIG. 5 is a cross sectional view of the screw setter device of the present invention.
Figure 6:
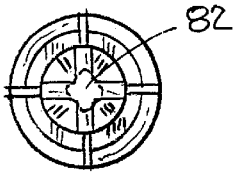
FIG. 6 is a bottom view of the screw setter device depicting the phillips driving bit arrangement.
Figure 7:
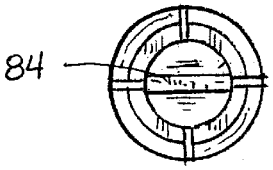
FIG. 7 is a bottom view of the screw setter device depicting the slotted driving bit arrangement.
Figure 8:
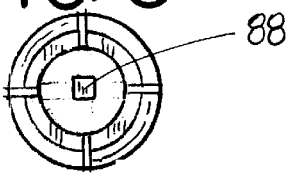
FIG. 8 is a bottom view of the screw setter device depicting the square driving bit arrangement.

The driving tip 28, shown in FIG. 5, is positioned between the prongs 24 and includes a first end 72 and a second end 74. The first end 72 is fastened to the shank 20 and to the collet 40 by welding, epoxy, bolts, rivets, or other means known to those skilled in the art. The driving tip 28 may also include a hexagonal exterior surface so the driving tip 28 can be slid in and out of the collet 40 to allow for interchangeability. The second end 74, which is even with retaining clip 56, includes a tip 78 shaped to match and engage a recess 80 in the head 38 of the screw 16, shown in FIG. 4. The tips 78 can be of various configurations such as phillips 82, FIG. 6, flat 84, FIG. 7, and square 88 FIG. 8 shaped and can also be of various sizes. Other driving tip 28 configurations can also be utilized to accommodate the type of screw 16 used. For example, tip 78 of the phillips 82 configuration, shown in FIG. 3, can be sized as a No. 1, No. 2 or No. 3, depending upon the size of the screw 16 to be installed. When the screw head 38, shown in FIG. 4, is inserted between the prongs 24, the recess 80 in the screw head 38 engages the tip 78 to allow the screw 16 to be rotated when the screw setter device 10 is turned. The device 10 can also be utilized to grippingly engage screws with hexagonal heads.

The collet 22, shown in FIG. 4., is cylindrical in shape and includes a first end 92, a spaced apart second end 94, an inner surface 96 and an outer surface 98. The inner surface 96 includes a central bore 100 to allow the collet 22 to slide over the outer surface 30 of the shank 20. The central bore 100 is sized so that when the first end 92 is slid over the raised ring 51 and the crown 54, the prongs 24 are clamped to the closed position. The inner surface 96 also includes a first annular recess 102 and a second annular recess 104, shown in FIG. 5. The first annular recess 102 of the sleeve 22 is adapted to engage the raised ring 51 of the collet 40 to aid in closing the prongs 24 around the head 38 of the screw 16, shown in FIG. 4. The second annular recess 104 is adapted to engage the crown 54 of the prongs 24 to close the prongs 24 around the screw head 38. The diameters of the first and second annular recesses 102 and 104 are sized so that when slid forward over the raised ring 51 and the crown 54, the prongs are squeezed from an open position to the closed position. The first end 92 of the sleeve 22 is adapted so that when a bottom surface 106 of the sleeve 22 contacts the structure into which the screw 16 is being inserted, the sleeve 22 moves rearward, with respect to the prongs 24 thereby opening the prongs 24. As the screw 16 is driven into the surface the prongs 24 indent the structure as they are pulled inward along with the screw head 38. The wood structure naturally indents from the force applied by the screw setter device 10. Once the prongs 24 are opened the screw setter device 10 automatically releases from the screw 16. With this arrangement, the screw 16 is sunk into the structure $\frac{1}{16}$of an inch before the screw setter device 10 releases. The depth of release can be altered by increasing or decreasing the overhang of the bottom surface 106 of the sleeve 22. To sink the screw 16 deeper into the structure, the sleeve 22 can be removed from the shank 20 and reversed, as shown in FIG. 3, so that the second end 94 is facing the prongs 24. To allow for adjustable depth, an adjustable collar 26, shown in FIG. 4, is placed around the outer surface 98 of the sleeve 22. The collar 26 is ring shaped and includes a central aperture 112, a slit 108 and a screw 110. The central aperture 112 of the collar 26 is slid over the outer surface 98 of the sleeve 22. When the collar 26 is positioned to achieve the proper countersink depth, the screw 110 is rotated clockwise to clamp the collar 26 to the sleeve 22. To countersink the screw 16 to the desired depth set by the collar 26, a hole must be pre-drilled to the same diameter as the outer surface 98 of the sleeve 22 so when the screw 16 is installed, the sleeve 22 can sink into the structure until the structure contacts the side surface 114 of the collar 26. When the side surface 114, shown in FIG. 3, of the collar 26 contacts the structure into which the screw 16 is installed, the sleeve 22 moves rearward allowing the prongs 24 to open, releasing the screw setter device 10 from the screw 16. The collar 26 can be clamped at different points on the sleeve 22 depending on the desired depth of the screw 16 into the structure.

To use the screw setting device 10, shown in FIG. 1, the shank 20 is installed in the chuck 32 of an electric drill. The sleeve 22 is slid rearward allow the four prongs 24 to open. A screw 16 is then inserted into the annular recess 58 created by the four prongs 24 and is positioned so that the driving tip 78 engages the recess in the screw head 80. Once the screw head 38 is in position between the four prongs 24, the sleeve 22 is slid forward, closing the prongs 24 around the screw head 38 so that the retaining clips 56 engage the rear face 70 of the screw head 38. Once the screw is locked into the screw setter device 10, the tip 116 of the screw 16 is pressed into a piece of wood and the drill 12 is energized, rotating the screw into the wood. The screw setter device 10 will maintain the connection between the driving tip 28 and the screw head 38 until the screw 16 is completely installed into the wood. As the screw head 38 becomes flush with the surface of the wood, the bottom surface 106 of the sleeve 22 engages the wood and causes the sleeve 22 to slide backwards, opening the prongs 24. Once the prongs 24 are opened, the rotational force of the drill causes the screw setter device 10 to release from the screw head 38. Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A fastener installation device comprising:

a shank having a first end adapted to be connected to a rotary device and a second end having a driving tip, said driving tip adapted to engage and rotate the fastener;

a collet rigidly connected to said shank;

a plurality of prongs extending from said collet disposed about said driving tip adapted to surround and grippingly engage the head of the fastener, said prongs radially spaced from each other and resiliently biased away from said driving tip;

said collet further including a support surface adapted to engage the top of the fastener head; and a reversible sleeve disposed about said collet and movable linearly along said shank with respect to said collet, said sleeve adapted to bias said prongs radially inward when said sleeve is moved over said prongs toward said second end of said shank, thereby causing said prongs to grippingly engage the head of the fastener whereby the fastener is kept in constant engagement with said driving tip and prongs during installation of the fastener.

2. The fastener installation device of claim 1, including an adjustable collar disposed about said sleeve and adjustable to various positions along said sleeve to allow the fastener to be installed at variable depths.

3. The fastener installation device of claim 1, wherein said sleeve has an inner surface.

4. The fastener installation device of claim 3, wherein said inner surface includes a central bore.

5. The fastener installation device of claim 1, wherein said sleeve has a first annular recess adapted to engage a raised ring of said collet.

6. The fastener installation device of claim 5, wherein said sleeve has a second annular recess adapted to engage and bias said prongs to a closed position.

7. The fastener installation device of claim 1, wherein said sleeve has a first end adapted come in contact with a structure when the fastener is completely installed and moving said sleeve rearward releasing said prongs from the head of the fastener.

8. A fastener installation device comprising:

a shank having a first end adapted to be connected to a rotary device and a second end having a driving tip, said driving tip adapted to engage and rotate the fastener;

a collet connected to said shank;

a plurality of prongs extending from said collet disposed about said driving tip adapted to surround and grippingly engage the head of the fastener, said prongs radially spaced from each other;

a reversible sleeve slidably disposed about said shank and movable along side shank with respect to said collet, said sleeve adapted to bias said prongs radially inward when said sleeve is moved over said prongs toward said second end of said shank, thereby causing said prongs to grippingly engage the head of the fastener; and, a collar slidably disposed about said reversible sleeve and laterally movable with respect thereto, said collar adapted to limit the depth of the fastener during installation when said sleeve is in a reversed position;

whereby the fastener is kept in constant engagement with said driving tip and prongs during installation of the fastener.

9. A fastener holding device including:

a shank adapted to be engaged by a rotary device;

a driving tip connected to and extending from said shank and adapted to engage a fastener head;

a collet mechanism rigidly connected to said shank and surrounding said driving tip, said collet mechanism including a plurality of prongs spaced outwardly from and positioned radially around said driving tip, said prongs biased radially outwardly to a release position;

said collet mechanism further including a support surface adapted to engage the top of the fastener head; and a reversible sleeve surrounding said collet, and slidable linearly along said shank with respect to said collet, said sleeve having a first end slidable to engage said prongs and force said prongs radially inwardly from said release position to an engage position, such that said prongs grippingly engage the exterior of the fastener head and secure it to said driving tip.

10. A fastener holding device as in claim 9 in which said shank is connected to said driving tip for rotary movement therewith.

11. A fastener holding device as in claim 10 in which said shank and said driving tip are formed at opposite ends of a shaft.

12. A fastener holding device as in claim 9 in which in which said collet mechanism is connected to said shank for rotary movement therewith.

13. A fastener holding device as in claim 9 in which said sleeve includes an enlarged head at one end such that, when said enlarged head engages the surface of the material into which said fastener is being installed, the enlarged head causes said sleeve to slide away from the surface allowing said prongs to move from said engaged position to said release position, thereby releasing the fastener from said fastener holding device.

14. A fastener installation device with automatic release including:

a shank having a first end adapted to be connected to a rotary device;

a second end having a driving tip connected to and extending from said shank;

a collet rigidly connected to said shank, said collet including a plurality of prong members surrounding said driving tip and resiliently biased away from said driving tip;

a reversible sleeve member defining a central aperture extending therethrough and including a first engaging surface at one end thereof and a second engaging surface at the other end thereof, said sleeve adapted to surround said collet and to slide linearly over and along said shank between a release position in which said sleeve member is out of engagement with said prongs and an engage position in which said sleeve engages said prongs and forces them radially inwardly to grippingly engage the head of the fastener and secure it in driving engagement with said driving tip whereby when said first engaging surface of said sleeve member contacts the surface into which the fastener is being driven and downward pressure is exerted against the shank the sleeve is automatically forced from said engage position to said release position thereby releasing said prongs from the fastener and the fastener from its engagement with the driving tip.

* * * * *